US005577831A

United States Patent [19]

Chang

[11] Patent Number: 5,577,831

[45] Date of Patent: Nov. 26, 1996

[54] LIGHT-EMITTING STRUCTURE OF A DECORATIVE TOY

[75] Inventor: Max Chang, Taipei Hsien, Taiwan

[73] Assignee: More Talents International Development Co., Ltd., Taipei Hsien, Taiwan

[21] Appl. No.: 585,461

[22] Filed: Jan. 16, 1996

[51] Int. Cl.[6] ..... F21P 1/02

[52] U.S. Cl. ..... 362/240; 362/251; 362/252; 362/246; 362/808; 362/124

[58] Field of Search ..... 362/124, 231, 362/235, 237, 240, 244, 246, 249, 251, 252, 355, 360, 800, 806, 807, 808, 86; 40/549, 550, 564; 446/219

[56] References Cited

U.S. PATENT DOCUMENTS

| | | | |
|---|---|---|---|
| D. 34,848 | 7/1901 | Norden | 40/550 |
| 3,145,493 | 8/1964 | Escalante | 362/252 |
| 3,972,139 | 8/1976 | Slomkowski | 40/564 |
| 4,281,364 | 7/1981 | LeFever et al. | 362/240 |
| 5,313,729 | 5/1994 | Sakai et al. | 362/240 |

*Primary Examiner*—Stephen F. Husar
*Assistant Examiner*—Thomas M. Sember
*Attorney, Agent, or Firm*—Alfred Lei

[57] ABSTRACT

A light-emitting structure of a decorative toy including a frame including an inner side wall and an outer side wall between which there is a groove provided with a plurality of partitions. A transparent upper cover is arranged on a top of the frame and a printed circuit board is mounted on a lower side of the frame. A plurality of light emitting members are at a circumference of the circuit board adapted to be located within the groove of the frame controlling means is electrically connected to the light emitting members via an electrical cord and provided with a loudspeaker and a switch. A translucent gem is filled into the groove of the frame to form a translucent region around a circumferential portion of the frame and to fix the printed circuit board within the frame. A bottom cover is fixedly mounted on a bottom side of the frame.

5 Claims, 2 Drawing Sheets

LIGHT-EMITTING STRUCTURE OF A DECORATIVE TOY

BACKGROUND OF THE INVENTION

1. Field of the Invention

This invention relates to a light-emitting structure of a decorative toy.

2. Description of the Prior Art

It has been found that the conventional decorative toy is usually in a shape of a person or an animal and has no other functions than still decoration. Therefore, it is an object of the present invention to provide a decorative toy which can give light and produce music so as to make it more funny and interesting.

SUMMARY OF THE INVENTION

This invention relates to a light-emitting structure of a decorative toy.

It is the primary object of the present invention to provide a light-emitting structure of a decorative toy which can give light and produce music as desired.

It is another object of the present invention to provide a light-emitting structure of a decorative toy which can give light looking like a neon lamp.

It is still another object of the present invention to provide a light-emitting structure of a decorative toy which is simple in construction.

It is still another object of the present invention to provide a light-emitting structure of a decorative toy which can be placed at the market at a very low cost.

It is a further object of the present invention to provide a light-emitting structure of a decorative toy which is funny and interesting.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
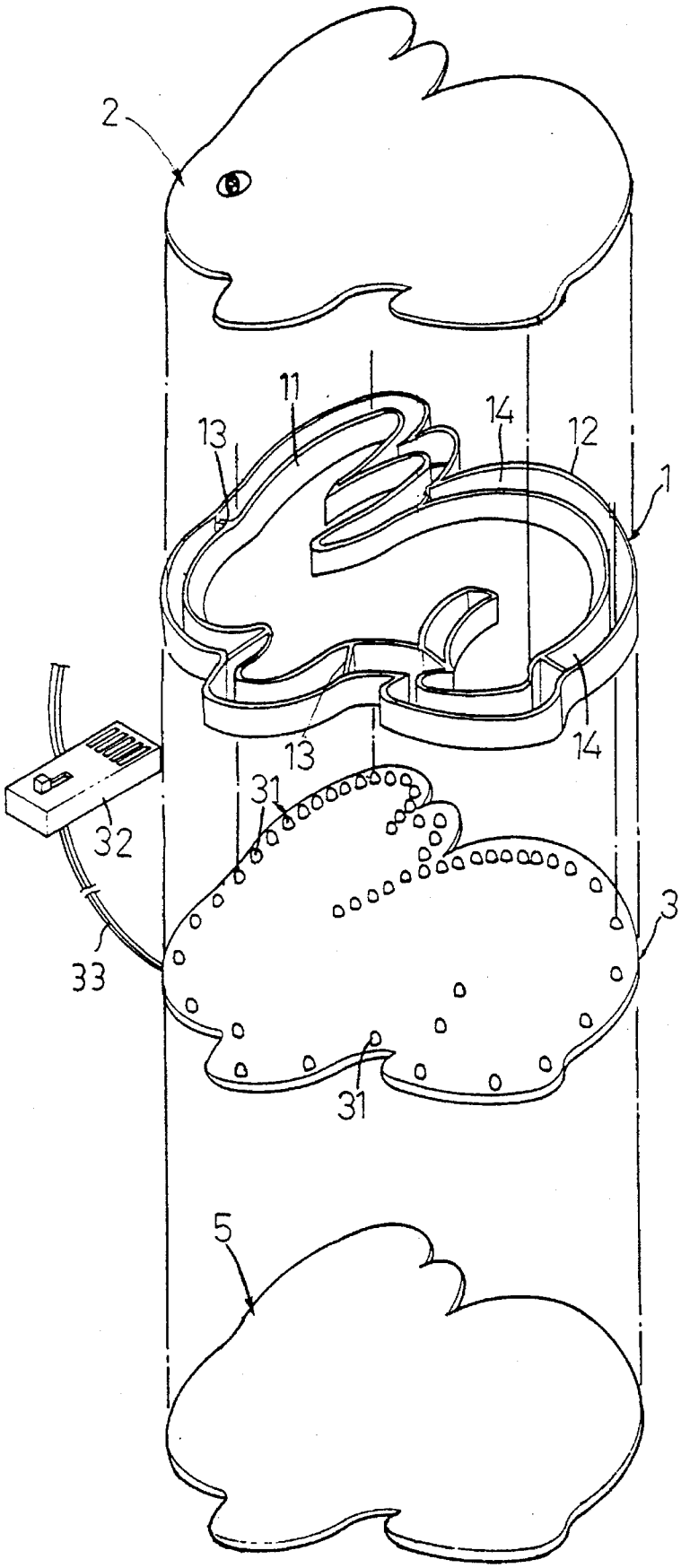
FIG. 1 is an exploded view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
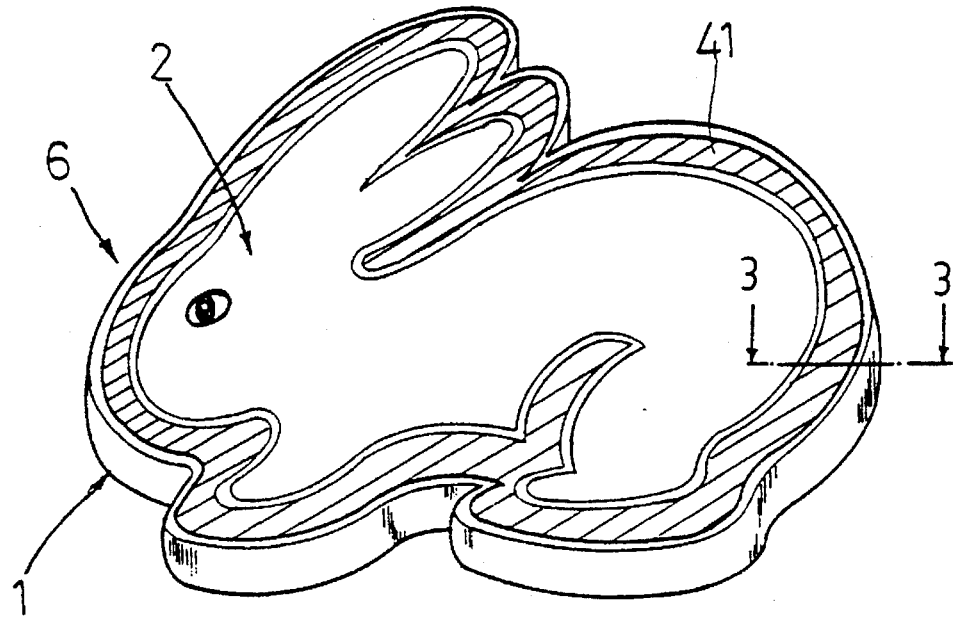
FIG. 2 is a perspective view of the present invention.
Figure 3:
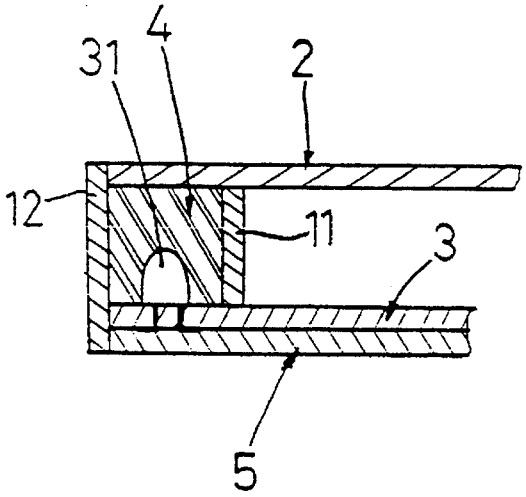
FIG. 3 is a sectional view taken along line 3—3 of FIG. 2.

With reference to the drawings and in particular to FIGS. 1, 2 and 3 thereof, the present invention mainly comprises a frame 1, an upper cover 2, a printed circuit board 3 and a bottom cover 5.

The frame 1 includes an inner side wall 11 and an outer side wall 12 between which there is a groove 14 provided with a plurality of partitions 13.

The upper cover 2 is a transparent member with a refractive property and arranged on the top of the frame 1.

Figure 4:
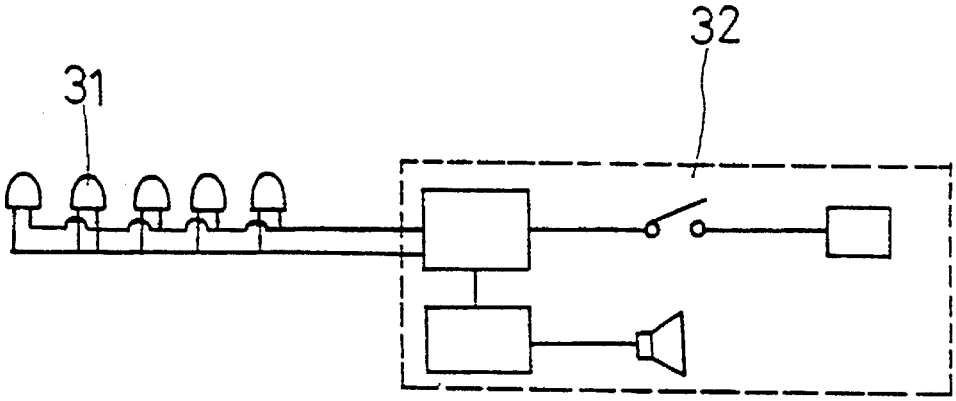
FIG. 4 is a circuit diagram of the present invention.

The printed circuit board 3 is mounted on the lower side of the frame 1 (see FIG. 3). The circumference of the printed circuit board 3 is provided with a plurality of light emitting diodes 31 or the like so that when the printed circuit board 3 is mounted on the lower side of the frame 1, the light emitting diodes 31 will be just located within the groove 14 of the frame 1. The light emitting diodes 31 are of different colors and electrically connected to a controller 32 via an electrical cord 33. The controller 32 is provided with a loudspeaker and a switch (see FIG. 4) and adapted to connect to a power supply (not shown) via an electrical cord. The controller 32 will produce sound and make the light emitting diodes 31 give light or flash in sequence when turned on. However, the controller 32 may be of any conventional design well known to those skilled in the art and is not considered a part of the invention. The groove 14 of the frame 1 is filled with a translucent gem 4 with a refractive property thereby forming a translucent region 41 around the circumference of the upper side of the frame 1 and fixing the printed circuit board 3 within the frame 1. The bottom cover 5 is fixedly mounted on the bottom side of the printed circuit board 3 (see FIG. 3). Hence, when the controller 32 is turned on, the translucent region 41 will give light as a neon lamp thus producing a romantic atmosphere.

Referring to FIG. 1 again, the light emitting diodes 31 may be arranged at different distance intervals so that the translucent region 41 will be brighter at some portion than another portion. Further, the light emitting diodes 31 may be controlled to flash in sequence by the controller 32.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A light-emitting structure of a decorative toy comprising:

a frame including an inner side wall and an outer side wall between which there is a groove provided with a plurality of partitions;

a transparent upper cover arranged on a top of said frame;

a printed circuit board mounted on a lower side of said frame, said printed circuit board being provided with a plurality of light emitting members at a circumference thereof adapted to be located within said groove of said frame;

controlling means electrically connected to said light emitting members via an electrical cord and provided with a loudspeaker and a switch;

a translucent gem filled into said groove of said frame to form a translucent region around a circumferential portion of said frame and fix said printed circuit board within said frame; and a bottom cover fixedly mounted on a bottom side of said frame.

2. The light-emitting structure of a decorative toy as claimed in claim 1, wherein said light-emitting members are arranged at different distance intervals.

3. The light-emitting structure of a decorative toy as claimed in claim 1, wherein said gem is of a refractive property.

4. The light-emitting structure of a decorative toy as claimed in claim 1, wherein said light-emitting diodes are of different colors.

5. The light-emitting structure of a decorative toy as claimed in claim 1, wherein said transparent upper cover is a refractive member.

* * * * *